US005634296A

United States Patent [19]

Hebda

[11] Patent Number: 5,634,296

[45] Date of Patent: Jun. 3, 1997

[54] REMOTE CONTROL DOOR OPERATING DEVICE

[75] Inventor: Thomas J. Hebda, Lombard, Ill.

[73] Assignee: Carol A. Hebda, Lombard, Ill.

[21] Appl. No.: 242,969

[22] Filed: May 16, 1994

[51] Int. Cl.[6] ..... E05F 11/28

[52] U.S. Cl. ..... 49/345; 49/28

[58] Field of Search ..... 49/280, 339, 340, 49/341, 345, 25, 26, 28; 16/65, 70, 80

[56] References Cited

U.S. PATENT DOCUMENTS

| | | | |
|---|---|---|---|
| 66,873 | 7/1867 | Newton | 16/80 |
| 350,560 | 10/1886 | Ring | 16/70 |
| 618,053 | 1/1899 | Brown | 49/340 X |
| 2,843,376 | 7/1958 | Osuch et al. | 49/26 X |
| 2,924,449 | 2/1960 | Leimer . | |
| 3,284,950 | 11/1966 | Gute . | |
| 3,886,425 | 5/1975 | Weiss | 49/28 X |
| 4,330,958 | 5/1982 | Richmond | 49/340 X |
| 4,348,835 | 9/1982 | Jones et al. | 49/345 X |
| 4,429,490 | 2/1984 | Zunkel | 49/340 X |
| 4,658,545 | 4/1987 | Ingham et al. | 49/28 X |
| 4,669,218 | 6/1987 | Kornbrekke et al. | 49/28 X |
| 4,972,629 | 11/1990 | Merendino . | |
| 5,018,304 | 5/1991 | Longoria | 49/26 X |
| 5,040,331 | 8/1991 | Merendino . | |

*Primary Examiner*—Kenneth J. Dorner
*Assistant Examiner*—Jerry Redman
*Attorney, Agent, or Firm*—Patnaude, Videbeck & Marsh

[57] ABSTRACT

A door controlling device for opening and closing a door in a wall has a first arm, one end of which is mounted to the wall and the other end of which is pivotally attached to the second end of a second arm. The first end of the second arm is pivotally attached to the top of a door and is adapted for rotation about a horizontal axis at the first end thereof. An electric motor attached to the device has a shaft which drives a gear train, and an output shaft of the gear train is connected to the input end of an electrically operated clutch. The output shaft of the clutch is connected to the first end of one of the arms such that upon the simultaneous engagement of the clutch and the energizing of the motor, that arm will be rotated about the horizontal axis at the first end and will cause the door to be opened or closed. Also, a current measuring device for determining whether the motor is drawing on excessive amount of electric current, a door open sensor for generating a signal when the door is in a fully opened position, and a door closed sensor for generating a signal when the door is in a fully closed position are all connected to a computer to control the opening and closing of a door.

20 Claims, 6 Drawing Sheets

REMOTE CONTROL DOOR OPERATING DEVICE

The present invention relates to a motor driven mechanism for opening and closing a door, and in particular to a mechanism which can be operated remotely from the door.

BACKGROUND OF THE INVENTION

Several devices are available which use an electric motor to control the opening and closing of a door to a room. Devices are also available for which the opening or closing cycle can be initiated from a remote location using an infrared transmitters and the like such as disclosed in U.S. Pat. No. 5,040,331. Such door controlling devices must be constructed so as not to be damaged when the door is manually opened or closed, or when an object such as a chair blocks the opening or closing of the door.

Currently available door controlling devices utilize a slip clutch or the like which create a drag or resistance when the door is manually opened or closed. Furthermore, such slip clutches do not terminate the door opening or closing cycle when the movement of the door is interrupted by contact with an item such as a chair or a person's hand and, as a result, such devices apply a force against the obstruction until the operating cycle is completed. It is, therefore, desirable to provide a door controlling device which can be operated remotely to open and close a door, which will not create resistance when the door is not manually opened or closed, and for which the opening or closing cycle will terminate when the door encounters an obstruction which prevents completion of the opening or closing cycle.

SUMMARY OF THE INVENTION

The present invention is embodied in a door controlling device for opening and closing a door in a wall. The device has a first arm, one end of which is pivotally mounted to the wall and the other end of which is pivotally attached to the second end of a second arm. The first end of the second arm is pivotally attached to the top of a door and is adapted for rotation about a horizontal axis at the first end thereof. An electric motor attached to the device has a shaft which drives a gear train, and an output shaft of the gear train is connected to the input end of an electrically operated clutch. The output shaft of the clutch is connected to the first end of the second arm such that upon the simultaneous engagement of the clutch and the energizing of the motor, the second arm will be rotated about the horizontal axis and will cause the door to which the device is attached to be opened or closed.

The invention also includes a start means for starting the cycle, such as a switch, or a infrared transmitter and receiver, a current measuring device for determining whether the motor is drawing on excessive amount of electric current, a door open sensor for generating a signal when the door is in a fully opened position, and a door closed sensor for generating a signal when the door is in a fully closed position. A control means, which is typically a computer, responds to the start means, the current measuring means, the door open sensor, and the door close sensor to direct current to the electric motor and to the clutch upon receipt of a signal from the start means, and for terminating power to the motor and the clutch upon receipt of a signal from the current measuring means, the door open sensor or the door close sensor.

In accordance with the present invention, the electrically operated clutch may be a wrap spring clutch or the like which provides positive drive from the input shaft to the output shaft only when the clutch is electrically energized. The device is, therefore, entirely disengaged when the motor is not operating. When the moving door contacts a foreign object such as a chair or a person's hand, the current measuring means will detect an increase in the current drawn by the electric motor in response to the resistance caused by the foreign object and in response thereto the computer means will terminate power to both the electric motor and the clutch thereby disengaging the operating device.

Currently available electrically operated clutches function when the input shaft rotates in only one direction. Reverse directional electric clutches are not currently available and, as a result, electrically operated clutches cannot be used on door opening and closing devices which require that the motor be reversed. The present invention, on the other hand, requires a motor which operates in only one direction and, therefore, can use currently available electrically operated clutches.

GENERAL DESCRIPTION OF THE DRAWINGS

A better understanding of the present invention can be had after reading the following detailed description taken in conjunction with the drawings in which.

DETAILED DESCRIPTION OF A PREFERRED EMBODIMENT

Figure 1:
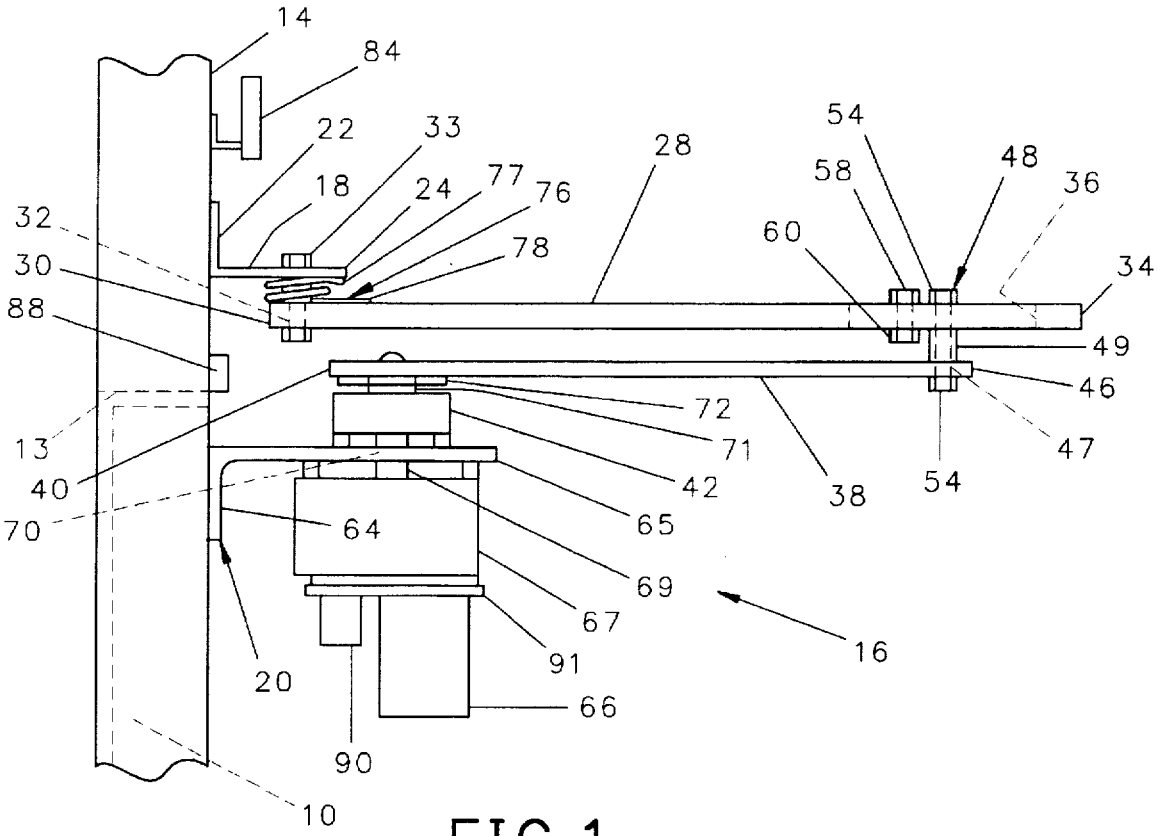
FIG. 1 is a side elevational view of a door operating device in accordance with the present invention attached to a door which is in the closed position with portion thereof shown in phantom lines.

Referring to FIGS. 1, 2, 3 and 4, a door 10 is pivotable about a horizontal axis of the pins 12 of a hinge to open and close against a frame which defines an opening 13 in a wall 14. A door operating device 16 is attached at its upper end to the wall 14 above the door 10 by a first bracket 18 and at its lower end is attached to the top of the door 10 by a second bracket 20. The first bracket 18 has a mounting portion 22 for attachment to the wall 14 and a substantially horizontal support member 24 with a transverse hole 26 at the distal end thereof.

A first arm 28 has a first end 30 through which there is a transverse hole 32, and a first pin 33 is slidably fitted through holes 26 and 32 to pivotally retain the first end 32 of the first arm 28 to the first bracket 18. The second end 34 of the first arm 28 has a longitudinal slot 36 therein. A second arm 38 has a first end 40 which is attached to the output shaft of a clutch 42 which is attached to the second bracket 20 as further described below. At its second end 46 the second arm 38 is connected to the second end 34 of the first arm 28 by a second pin 48 fitted in a second transverse hole 47 in the second arm 38 and which extends through a slide 43 mounted for movement along the longitudinal slot 36 as is further described below.

Figure 4:
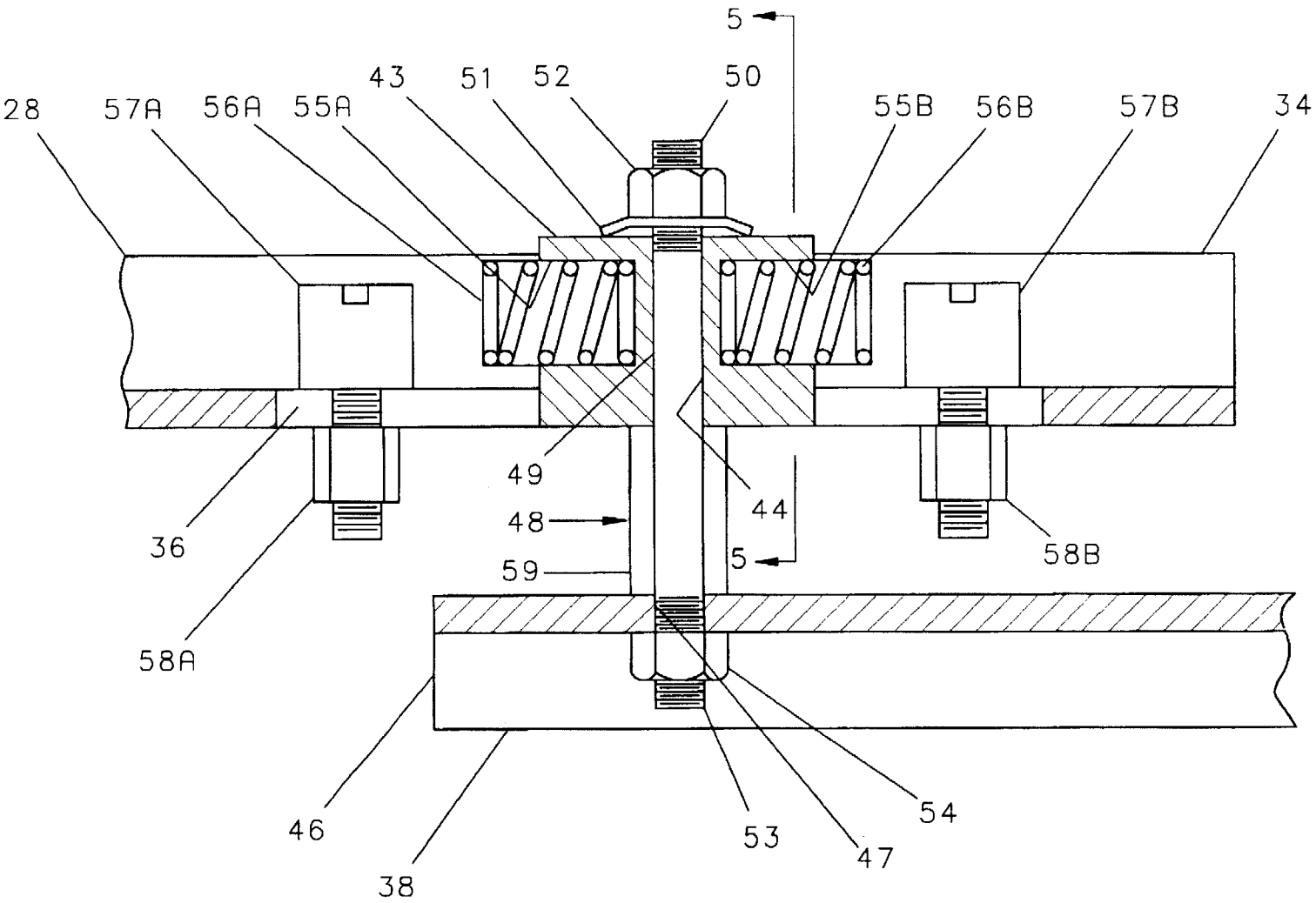
FIG. 4 is an enlarged fragmentary cross-sectional view of the device shown in FIG. 1 taken through line 4—4 of FIG. 2.
Figure 5:
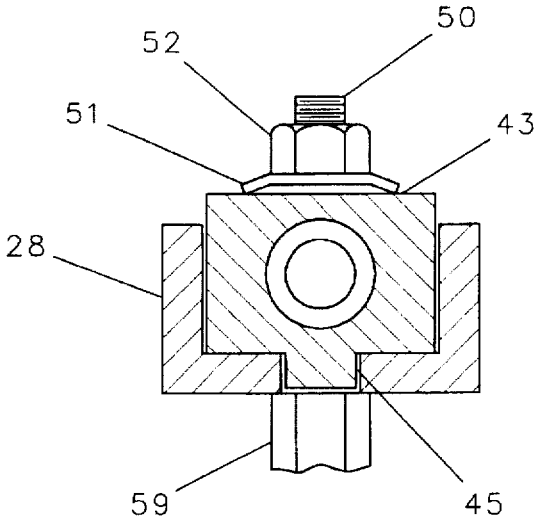
FIG. 5 is a fragmentary cross-sectional view of the second arm showing the mounting of the slide in the slot taken through line 5—5 of FIG. 4.

Referring to FIGS. 4 and 5, the slide 43 has a generally block shaped body with a longitudinal projection 45 extending along the bottom thereof. The projection 45 has a width which is a little narrower than the width of the slot 36, and depth which is a little more than the thickness of the second arm 34. A transverse hole 44 extends through the body 44 of the slide 43 and through the hole 45, an elongate end of the pin 48 is fitted. The pin 48 has a lower shaft 49 and an upper threaded end 50 which extends through the upper surface of the slide 43. A belleville washer 51 is fitted over the end 50 of the pin 48 and a nut 52 threaded thereon.

As best seen in FIGS. 4 and 5, the mid-portion 59 of the pin 48 has a hexagon cross section which is wider than the width of the slot 36, such that the pin 48 retains the longitudinal projection 45 of the slide 43 within the slot 36. Also, tightening of the nut 52 compresses the belleville washer 51 thereby increasing the friction to the movement of the slide 43 along the slot 36.

The lower end of the pin 48 is a threaded stud 53 which is fitted through the second hole 47 in the second arm 38 and retained therein by another nut 54.

As best seen in FIG. 4, first and second blind bores 55A, 55B, respectively, having axes parallel to the slot extend one into each end of the slide 43 and into each blind bore 55A, 55B is fitted compression springs 56A, 56B, respectively, such that the free end of each compression spring 56A, 56B extends outward of the ends of the slide 43. Also, on each side of the slide 43 are first and second adjusting bolts 57A, 57B, respectively, the ends of which extend through the slot 36 and are held firmly in place by nuts 58A, 58B tightened thereon. The movement of the slide 43 along the slot 36 is thereby limited by the two adjusting bolts 57A, 57B, and the impact of the moving slide 43 against the adjusting bolts 57A, 57B is cushioned by the springs 56A, 56B which will be compressed on such an impact.

Referring to FIG. 1, the second mounting bracket 20 has a mounting portion 64 having a plurality of transverse holes therein, not shown, for attachment of the mounting portion 64 to the surface of the door 10. Extending from one end of the mounting portions 64 is a generally horizontally oriented support member 65. An electric motor 66 and an integral gear train 67 are attached to the bottom of the support member 65 by a plurality of spaced nut and bolt assemblies, not shown. The output shaft 69 from the gear train 67 extends vertically through a transverse hole 70 in the support member 65 and into the electrically operated clutch 42, which is itself attached by a second plurality of bolts and nuts, not shown, to the upper surface of the support member 65. Extending vertically from the upper end of the clutch 42 is an output shaft 71 which has a transverse mounting plate 72 at the end thereof which is attached by a plurality of screws, not shown, to the first end 40 of the second arm 38. As can be seen, the second arm 38 is shorter than the first arm 28 and the second arm 38 can rotate 360 degrees about its first end 40. The first and second brackets 18, 20 are positioned on the door 10 and wall 14, respectively, such that when the second arm 38 rotates 360 degrees about its first end 40, the door 10 will go through both an opening and a closing cycle.

Figure 2:
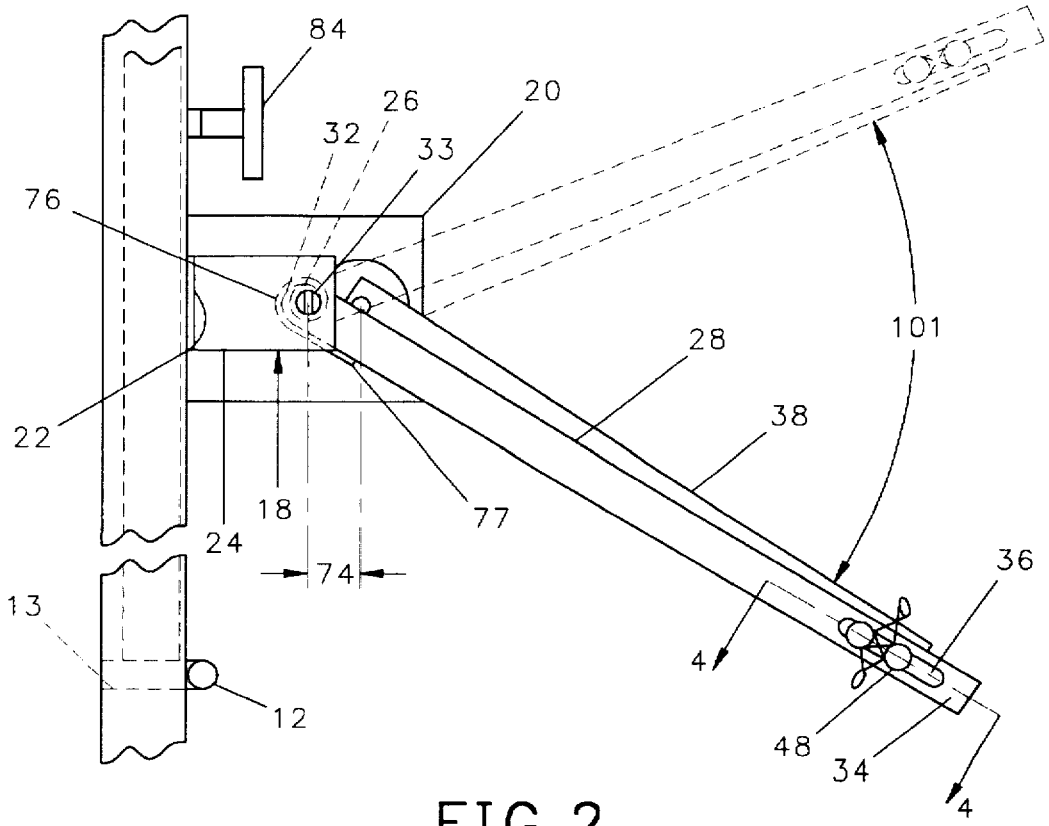
FIG. 2 is a top elevational view of the door operating device shown in FIG. 1 with the door in the closed position and the device in a first orientation as shown in solid lines and in a second orientation as shown in phantom lines.
Figure 3:
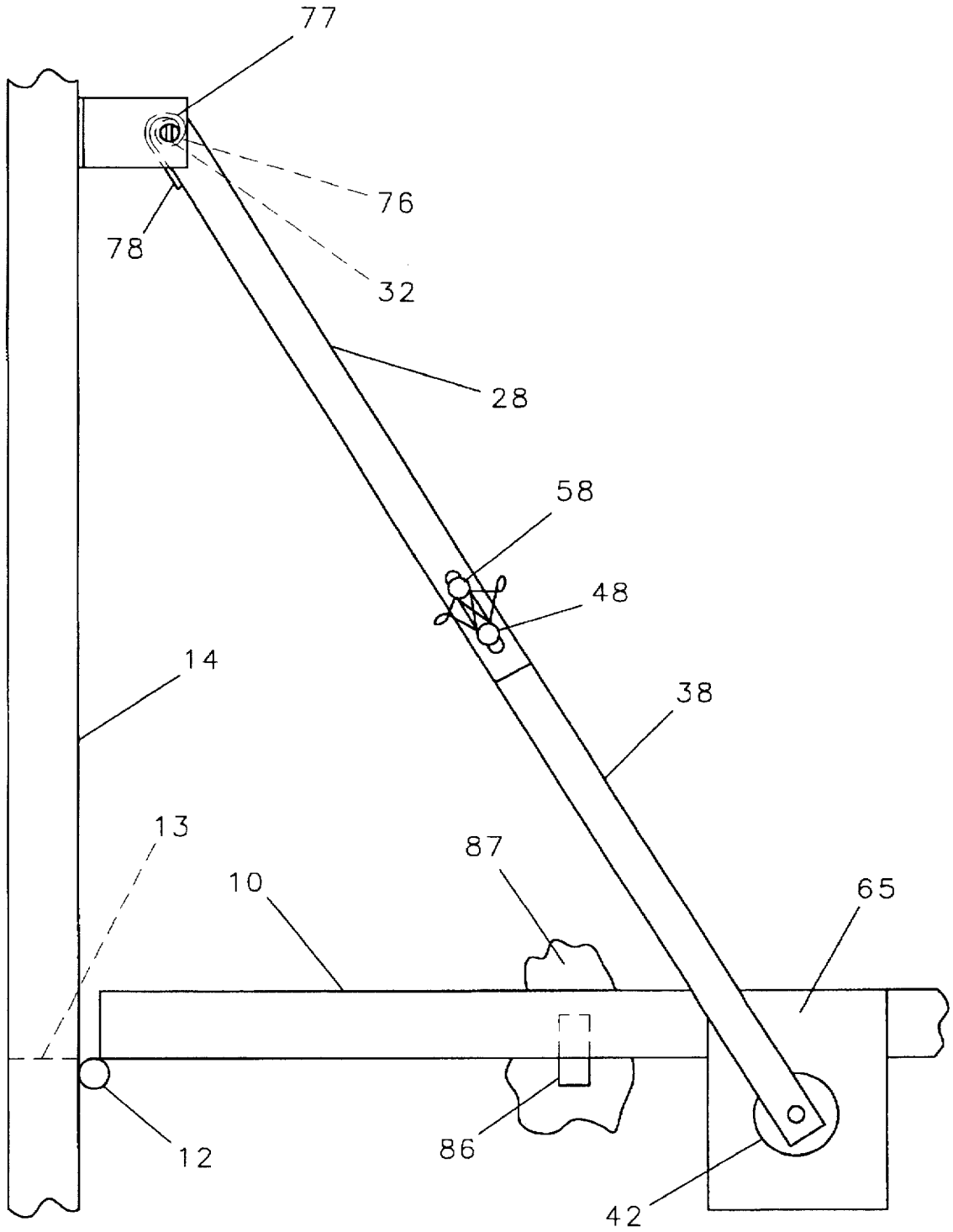
FIG. 3 is a top elevational view of the door operating device shown in FIG. 1 with the door in the open position.

As can be seen in FIGS. 1, 2 and 3, the first and second brackets 18, 20 are aligned such that when the door 10 is closed against the wall 14, the axis of the output shaft 71 extending from the clutch 42 and the axis of the first pin 33 are in a plane perpendicular to the closed door 10 and the wall 14. In this embodiment, the brackets 18, 20 of the control device 16 are also mounted on the side of the door 10 and the wall 14 against which the door 10 closes. The output shaft 69 of the gear train 67 and the output shaft 71 of the clutch 43 are also positioned on the support member 65 of the second bracket 20 a distance from the surface of the door 10 which is greater than the distance of the pin 33 from the wall 14, and the difference of these distances is shown as a distance 74. Also, the length of the first arm 28, that is the distance from the first pin 33 to the outer end of the slot 36, is a little less than the length of the combined length of the second arm 38 and the distance indicated by indicia No. 74, where the length of the second arm 38 is the distance between the holes 47 and 70 at the ends 40, 46 thereof. As a result, the two arms 28, 38 will be oriented at an angle relative to the door 10 and the wall 14 when the door 10 is closed as depicted in both phantom lines and solid lines in FIG. 2. Consequently, when the door 10 is closed, rotation of the second arm 38 about the output shaft 71 of the clutch 42 will force the door 10 to open away from the wall 14.

The clutch 42 is electrically operated such that when electric power is directed to the clutch 42, the clutch 42 will engage and the output shaft 69 of the gear train 67 will be connected to the shaft 71 attached to the second arm 38. Termination of power to the clutch 42 will result in the disconnection of the output shaft 69 from the shaft 71 such that neither the motor 66 nor the clutch 42 will create a resistance to the movement of the door 10 about the pins 12 except when the clutch 42 is engaged. Electrically operated clutches generally available have an internal spring which is constricted by a magnetic field formed when electric power is directed to the clutch. Constriction of the spring causes the clutch to engage the input shaft 69 to the output shaft 71. Such clutches will operate in one direction only.

Referring to FIGS. 1 and 2, the present invention further includes an over-center torsion spring 76 which is a coil spring wrapped around the first pin 33 and having a first end 77 which is attached to the horizontal support member 24 and a second end 78 attached to the first arm 28. The over-center spring 76 is adapted to urge the second end 34 of the first arm to rotate clockwise around the pin 33 as seen in FIG. 2. As a result, when the first arm 28 and the second arm 38 are aligned above one another and perpendicular to the plane of the wall 14, the over-center spring 76 will urge the first arm 28 to rotate to a position such that the first and second arms 28, 38 are not aligned perpendicular to the wall 14 when the clutch and the motor are disengaged. The provision of the over-center spring 76 prevents jamming of the device 16 when the door 10 is manually operated, jamming would otherwise occur if the first and second arms are oriented perpendicular to the wall 14.

Figure 6:
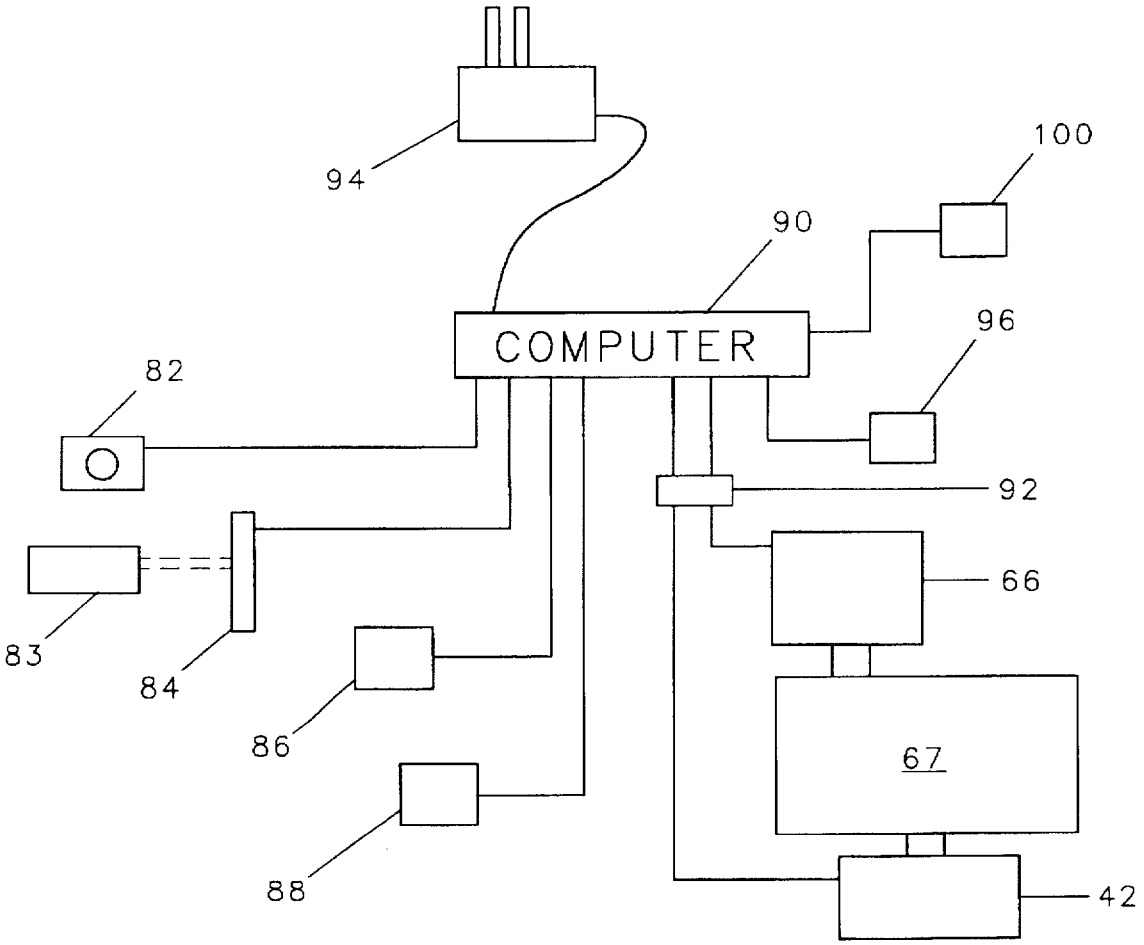
FIG. 6 is a schematic diagram of the circuit for the device shown in FIG. 1.

Referring to FIG. 6, to initiate a door opening or closing cycle, the invention includes starting means which may be a simple button 82 located either by the door 10 or by the desk of an operator. The starting means can also include an infrared hand held transmitter 83 and the receiver therefor 84 such as are commonly known in the art. A door open sensor 86 which may be actuated by the door contacting a switch, or some other means well known in the art, and is positioned on an adjacent wall or on the floor 87 where the switch will be contacted so that the sensor 84 will provide an electric signal when the door 10 is fully opened. A door close sensor 88, which may be built into the door frame and include a switch which will be actuated when the door 10 is within the opening 13 of the frame, and will provide a signal when the door 10 is fully closed against the wall 14. The sensors 86, 88 may be mechanically operated electric switches which are actuated by contact with the door as it reaches either the fully open or the fully closed positions.

The circuit for the present invention includes a control means, which may be a computer 90, in the form of a small chip mounted on a circuit board 91. The computer 90 controls a relay or transistorized switch 92 to connect or disconnect the electric motor 66 and the clutch 42 to a source of power, such as a step down transformer 94 attachable to an AC outlet, not shown. There is also provided a latch release 96 such as are known in the art for unlocking an outer door from within an apartment or the like. The latch release 96 is electrically operated upon actuation of the starting means and unlatches the door 10 in the event the door 10 is in a latched position. The circuit also includes an obstruction sensing means 100 which is a device for measuring the amperage drawn by the electric motor 66. In the event the door 10 encounters an obstruction while the motor 66 is running through either an opening cycle or a closing cycle, the electric motor 66 will then draw an increased current to overcome the obstruction. The obstruction sensing means 100 is of the type commonly known in the art and can be adjusted such that when the current drawn by the motor 66 exceeds the current normally required to move the door 10 through a cycle, the obstruction sensing means 100 will signal the computer 90 and the computer will disconnect power to the motor 66 and the clutch 42. It should also be appreciated that the obstruction sensing means 100 could also be a fuse or circuit breaker which will interrupt power to the motor and the clutch when the motor draws an excessive amount of power.

When the present invention is assembled to a door 10 which is in the closed position, and an operator desires to open the door, one of the starting means, either the button 82 or the infrared transmitter and receiver 83, 84, is actuated. Upon actuation of the starting means, the computer 90 directs power to the latch release 96 for a short interval of time to allow the door to open. Simultaneously, the computer 90 directs power to the motor 66 and the clutch 42 causing the first arm 28 to rotate in a clockwise direction about the horizontal shaft 71 as shown in FIG. 2. The latch release 96 should unlatch the door for a period of about one and one-half seconds to allow the motor 66 to move the door 10 out of the frame in the wall 14. Rotation of the first arm 28 causes a component of force to be applied through the second arm 38 against the wall 14 and causes the door 10 to open and pivot around pins 12. The door continues to open until the first and second arms 28, 38 are extended end to end in the orientation shown in FIG. 3, at which time the door has reached its fully opened position and will actuate the door open sensor 86. The shock absorbing spring 62 decelerates the door as the movement of the door pulls the pin 48 away from the adjusting bolt 58. The door open sensor 86, which may be positioned at any location where it can be actuated by the door just before it reaches its fully open position, will send a signal to the computer 90. The computer 90 will terminate power to the motor 66 and the clutch 42 and movement will stop. The opening or closing cycle of the door may also be stopped by a second actuation of the start means, that is, the button 82 or the infrared transmitter and receiver 83, 84.

While the motor 66 is cycling to open the door 10 as described above, the motor 66 will rotate the first arm 28 about the shaft 71 and apply a component of force upon the second pin 48 which is directed along the longitudinal axis of the first arm 28 and toward the first pin 33. This component of force will cause the slide 43 and the first pin 48 to slide within the longitudinal slot 36 and be compressed against the first spring 56A. A component of force will continue to hold the second pin 48 against the first adjusting bolt 57A through most of the door opening cycle as the door 10 is force away from the wall 14. At the end of the door opening cycle, however, when the door open sensor 86 is actuated and power is terminated to the electric motor 66, the first and second arms 28, 38 will be positioned end to end. As the door continues to move, the slide 43 will be pulled outwardly in the slot 36 until the second spring 56B impacts the second adjusting bolt 56B, and compresses the spring 56B, thereby decelerating the door. When the start means is again actuated, the computer 90 will again direct power to the motor 66 and the clutch 42 and the second arm 38 will again rotate clockwise around the shaft 71 thereby drawing the door 10 toward the wall 14. When in this cycle, the slide 43 will be moved until it contacts the second adjusting bolt 57B near the distal end of the longitudinal slot 36 and then will draw the door 10 toward the closed position. When the door 10 is finally moved within the opening 13 in the wall 12 the door closed sensor 88 will signal the computer 90 and the computer will terminate power to the motor 66 and the clutch 42.

When the door 10 reaches the closed position, the first and second arms 28, 38 will rotate across a position in which they are both perpendicular to the wall 14 to the position shown in solid lines in FIG. 2. At the time the door 10 reaches the latch closed position, the door closed sensor 88 will signal the computer 90, and the computer 90 will terminate power to the motor 66 and the clutch 42.

In the event the door closed sensor 88 and the computer 90 cause power to the motor 66 and the clutch 42 to terminate when the first and second arms 28, 38 have rotated only to the position shown in phantom lines in FIG. 2, the over-center spring 76 will cause the two arms 28, 38 to rotate through arch 101 from the position shown in phantom lines in FIG. 2 to the position shown in solid lines. The longitudinal slot 36 in the first arm 28 is sufficiently long for the second pin 48 to be located near a midpoint of the slot 36 when the door is closed and the longitudinal axes of the first and second arms 28, 38 are oriented one above the other and perpendicular to the wall 14.

While the door 10 is in the closed position and not in use, the over the center spring 76 will rotate the first and second arm 28, 38 out of the arch 101 and cause the first and second arms 28, 38 to be positioned with the longitudinal axes thereof at an angle which is not perpendicular to the wall 14, as shown in FIG. 2. As a result, manually opening or closing the door 10 will not damage the first and second arms 28, 38. Also, in the event the door 10 is engaged in either an opening or a closing cycle, and an obstruction prevents further movement of the door 10, the obstruction sensing means 100 will detect an excessive current drawn by the motor 66 and the computer 90 will terminate power to the motor 66 and the clutch 42 thereby disengaging both.

When the door is in the closed position, the slot 36 in the first arm 28 is nearly parallel to the length of the second arm 38 as shown in FIG. 2. If the door is manually opened, the opening door will exert a large component of force on the pin 48 to move the slide 43 along the slot 36 toward the outer end 34, and a small component of force on the pin 48 perpendicular to the length of arms 28, 38 causing the arms to rotate. The belleville washer 51 positioned on the pin 48 causes resistance to the movement of the slide 43 within the slot 36 and as a result a greater amount of force is applied to rotate the arms. This resistance to movement of the pin 48 in the slot 36 and the resulting rotation of the arms reduces jamming of the arms as the door is manually opened.

It should be appreciated that the axis of the first pin 33 and the axis of the output shaft 71 of the clutch 42 need not be in a plane perpendicular to the wall 14 when the door 10 is in the closed position, however, a different positioning of these axes will result in the leverage applied against the door during the door opening cycle being different from the leverage afforded during the door closing cycle. On the other hand, the risk of damage to the arms when the door is manually operated will be somewhat reduced. With such a configuration, the over the center spring would be oriented to move the arms so they are not in parallel alignment with each other when the door is closed, and the device is in the stand-by condition to prevent damage to the arms when the door is manually opened.

The device is depicted as being attached to a door having hinges on the left side when the door is viewed from the side into which the door opens. When the device is to be attached to a door hinged on the right side as viewed from the side into which it opens, the motor 66 and clutch will preferably operate in the opposite direction.

Figure 7:
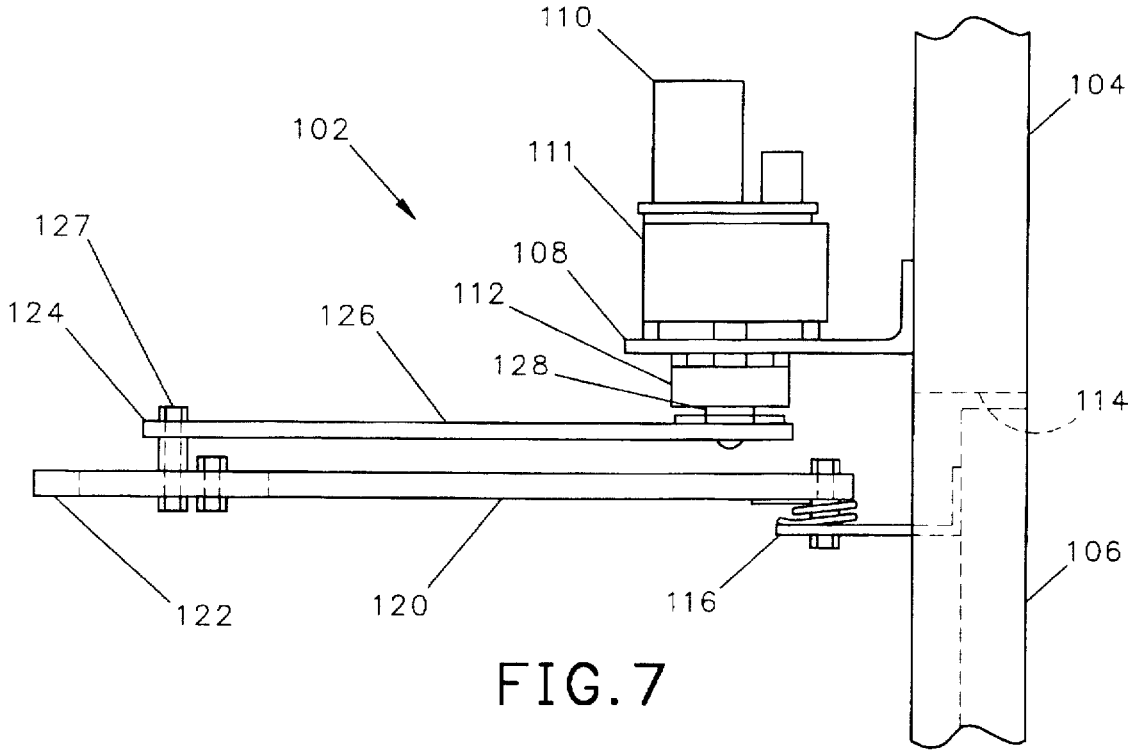
FIG. 7 is a side elevational view of an alternate embodiment of a door opening device embodying the present invention with portions shown in phantom lines.
Figure 8:
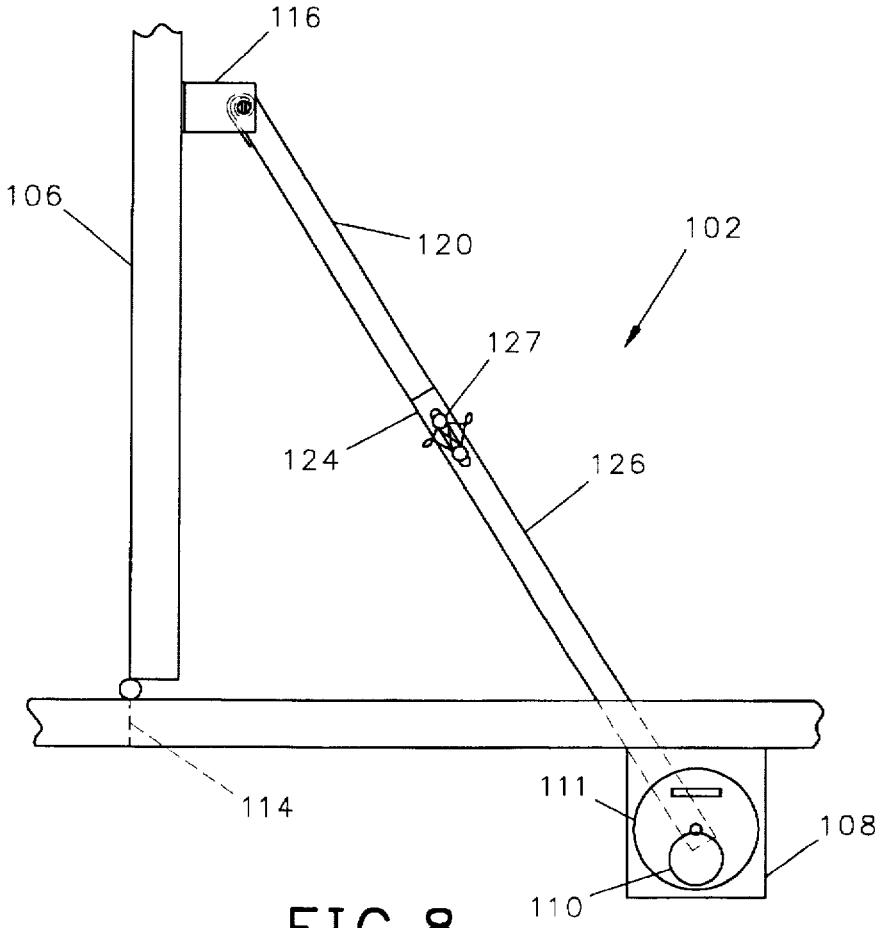
FIG. 8 is a top view of the door opening device shown in FIG. 7 with the door in the open position.

Referring to FIGS. 7 and 8, a door opening device 102 is depicted as attached to the side of a wall 104 which is opposite to the side against which the door 106 closes. In this embodiment, the first bracket 108 which supports the motor 110, the gear train 111, and the clutch 112 is attached to the wall 104 above the door opening 114 and the second bracket 116 is attached to the door 106. A long first arm 120 is pivotally attached at one end to the second bracket 116 and attached at its outer end 122 to the second end 124 of a second, short arm 126 by a pin 127. The second arm 126 rotates about the output shaft 128 of the clutch 112. In all other respects, the device 102 is identical to that shown with respect to the first embodiment 16. The device 102 must be positioned on a door 106 and wall 104 such that the outer end 124 of the short arms 126 can rotate 360 degrees and during a portion of this cycle extend through door opening 114 without the outer end 124 striking the sides of the door opening 114.

Figure 9:
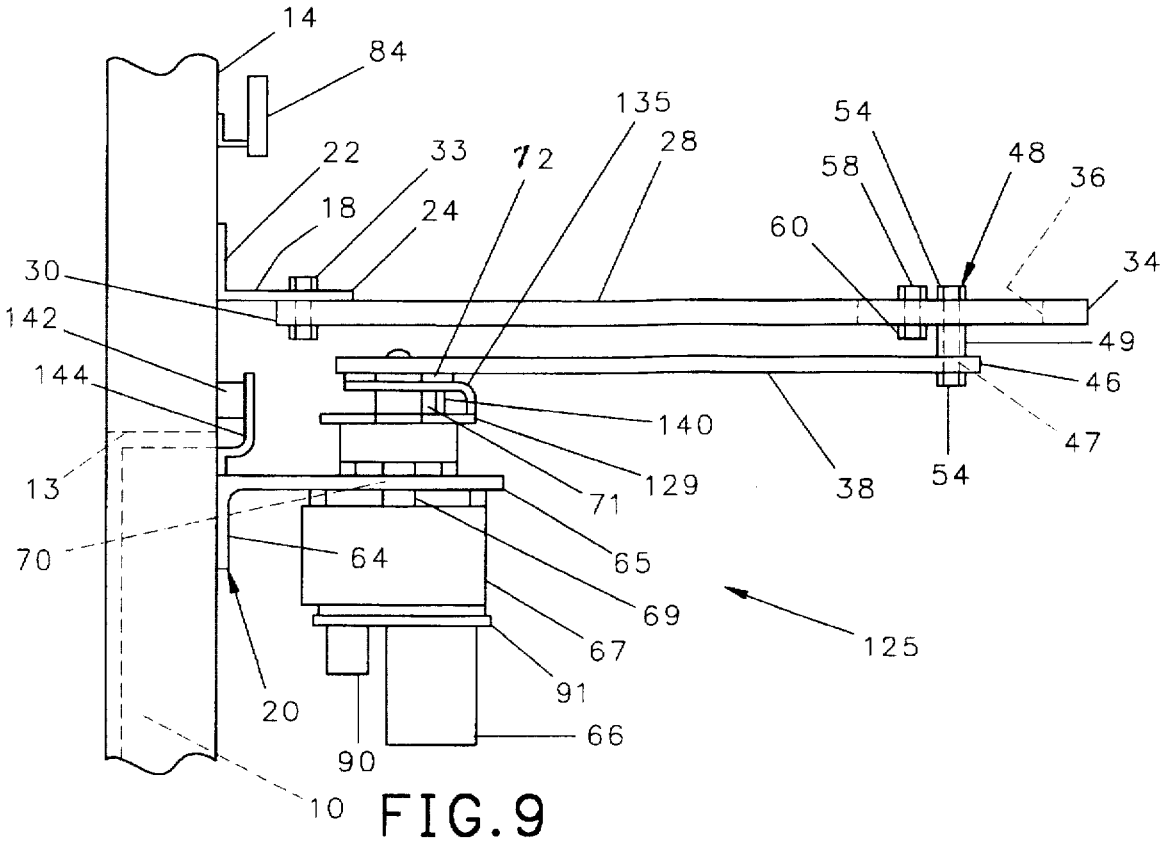
FIG. 9 is a side view of a second embodiment of a door opening device embodying the present invention.
Figure 10:
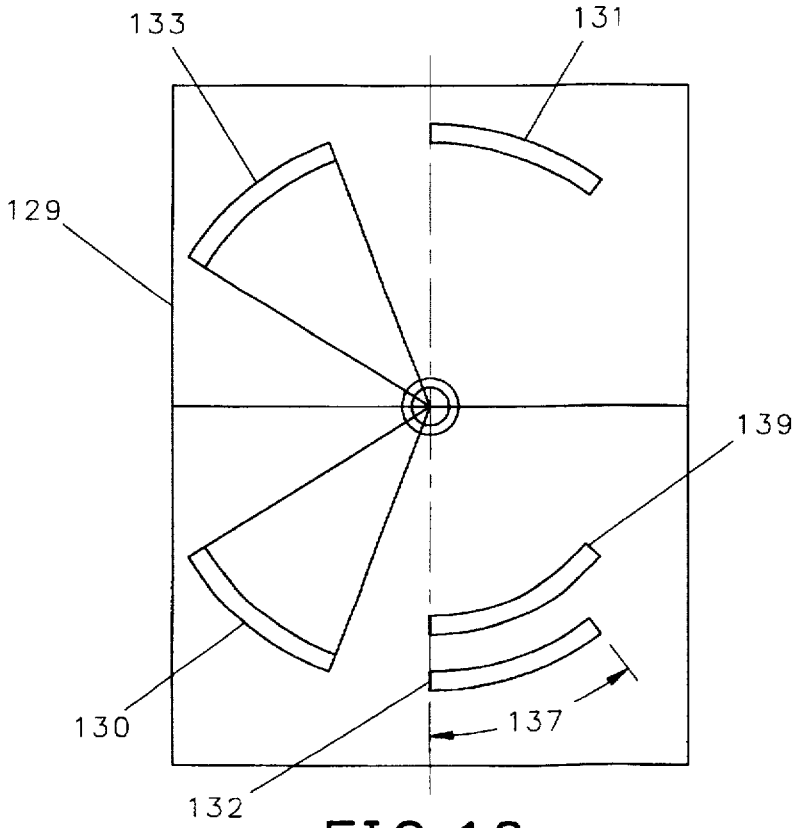
FIG. 10 is an enlarged top view of the circuit board for the door opener shown in FIG. 9.

In an alternate embodiment of a door operating device 125 is shown in FIGS. 9 and 10 in which the placement of the door open sensor 86 and the door close sensor 88 and the need for an over the center spring are all eliminated. In these figures, elements which are like those elements of the first embodiment bear like indicia numbers. The portions of the present invention shown include the clutch 42, a drive shaft 71 extending from the clutch 42 which is connected to the lower surface of the second arm 38 by a mounting plate 72. Surrounding the shaft 71 is a circuit board 129, best shown in FIG. 10, having four arcuate electrically conductive contact surfaces 130, 131, 132, 133. The circuit board 129 is positioned in a plane parallel to the plane in which the second arm 38 rotates and the arcuate surfaces 130, 131, 132, 133 are positioned to define arcs of a circle at the center of which is the shaft 71. Positioned on the lower surface of the second arm 38 is an electrically conductive contact arm or brush 135. The brush 135 is located and adapted to contact the arcuate surfaces 130, 131, 132, 133 as the arm 38 rotates about the shaft 71. The brush 135 and the contact surfaces 130, 131, 132, 133 form, therefore, the contact surfaces of electrical switches connected to the computer 90.

The arcuate contacts 130, 131, 132, 133 are angle sensing means which are contacted by the brush 135 when the arms 28, 38 are oriented at given angles to each other and when the door is open or closed. Arcuate contact 130 is positioned to be contacted by the brush 135 when the door is in closed position, and this contact substitutes for a door closed sensor. Similarly, contact 131 is positioned to be contacted when the door is fully opened and substitutes for a door open sensor.

Arcuate contact 132 will be contacted by the brush 135 through an arc 137 which is chosen to be congruent to the arc 101 for which jamming will occur if the door 10 is closed and manually opened. The computer 90 is programmed to energize the motor 66 and clutch 42 when the brush 135 is in contact with arcuate contact 132 and terminate power to the motor 66 and clutch 42 when this contact is broken. The motor 66 will, therefore, rotate the arms 28, 38 out of the arc 101 thereby eliminating the need for the over the center spring 76.

The over the center spring 76 of the first embodiment prevents alignment of the first and second arms and the jamming caused thereby when the door is in the closed position. A similar jamming problem will occur when a door that is opened with the first and second arms aligned in end-to-end relationship as shown in FIG. 3 and is then manually closed. When the first and second arms 28, 38 are aligned in end to end relationship, the arms act as a single arm spanning between the top of the door and the door frame and jamming will occur when one attempts to manually close the door. To avoid such jamming, the fourth arcuate contact 133 is positioned to be contacted by the brush 135 when the second arm 38 is oriented at an angle corresponding to end to end alignment of the first and second arms. The computer is again configured to energize the motor and clutch 42 while the switch is actuated, and terminate power when the switch 142 is released. The motor will, therefore, move the arms until they are no longer in end-to-end alignment, to an angled orientation as shown in FIG. 8, thereby eliminating jamming while closing the door.

Although this embodiment is depicted as having a brush and an arcuate surface to actuate a switch, there are numerous other embodiments for such a control. For example, a reed switch positioned on the lower surface of the second arm 38 and magnets positioned on the tabs 39, 40, 41 can substitute for the brush and contact surfaces described above.

The latch release 96, previously described, may be expensive to install. The latch release may also be eliminated by the provision of a third arcuate contact surface 139 provided on the circuit board 129. The contact surface 139 defines a circle having the shaft 71 at its center but having a different radius than the circle defined by arcs 130, 131, 132, 133. A second contact brush 140 is positioned on the lower surface of the second arm and adapted to contact the surface 139 during a portion of the rotation of the arm 38 for which the door 10 is closed and it would be desirable for the door to be latched. The brush 140 and contact surface 139 are then wired as a switch which activates an electromagnet 142. The electromagnet 142 is attached to the wall 14 above the door 10. A metal plate 144 is attached to the door 10 near its upper edge and is adapted to abut against the electromagnet 142 when the door is closed. When the door 10 is closed and the electromagnet 142 energized, the door 10 will be retained in the closed position as if latched by the attraction of the plate 144 to the electromagnet 142. The metal plate 144 can be attached at the top of the door 10 with a minimum expense. Also, the arc of the contact surface 129 can be chosen such that the electronic door latch 142, 144 will be actuated for a portion of the arc corresponding to the door closed position and released for the balance of the arc corresponding to the door open position. As a result, the door 10 can be closed and latched or unlatched by the operator by using the start means 82, 83.

As a result of the foregoing, there is disclosed a door operating device 16 which can be used to open and close a door 10 from a remote location and will not create a resistance to the manual operation of the door when the device is not in use. Furthermore, the device 16 will disengage altogether when the door 10 is engaged in a cycle to open or close, but encounters an obstruction.

While the present invention has been described in connection with one embodiment, it will be understood by those skilled in the art that many changes and modifications may be made within the true spirit and scope of the invention. Therefore, it is intended by the appended claims to cover all such changes and modifications which come within the true scope and spirit and of the invention.

What is claimed:

1. A door operating device opening and closing a door in an opening in a wall, said device comprising in combination:

a first arm having a first and a second end, said first end of said first arm pivotally attachable to said wall for movement about a first axis, a second arm having a first and a second end, said first end of said second arm pivotally attachable to said door for movement about a second axis, said second end of said first arm pivotally attached to said second end of said second arm, electric motor means for drivingly rotating one of said arms in a first direction about one of said first and said second axis, clutch means for connecting and disconnecting said motor means from engagement with said one of said arms, start means, door open sensor means for detecting when said door is opened, door closed sensor means for detecting when said door is closed, one of said first arm and said second arm having a longitudinal slot means at said second end thereof, the other of said first arm and said second arm having pin means at said second end thereof, said pin means for engagement in said slot means, and control means connected to said motor means and said clutch means and responsive to said door open sensor means, said door closed sensor means and said start means, for directing electric power to said motor means upon actuation of said start means and for terminating electric power to said motor means upon receipt of a signal from one of said door open sensor means, and said door closed sensor means.

2. The door opening device of claim 1 further comprising a slide slideable along said slot means and means for retaining said pin means on said slide.

3. A door operating device in accordance with claim 2 and further comprising:

angle sensing means for detecting when said first arm and said second arm are aligned in substantially parallel relationship with each other, switch means responsive to said angle sensing means, and said control means responsive to said switch means for directing power to said motor when said first and second arms are aligned in substantially parallel relationship.

4. A door opening device in accordance with claim 2 and further comprising:

resistance means for creating resistance to the movement of said slide within said slot means.

5. The door opening device of claim 2 further comprising adjusting means for adjusting the length of travel of said slide along said slot means.

6. The door opening device of claim 2 further comprising means for absorbing shock from said slide impacting against an end of said slot means.

7. The door opening device of claim 1 further comprising:

a slide slideable along said slot means, and means for retaining said pin means on said slide.

8. The door operating device of claim 7 further comprising adjusting means in said slot means for adjusting the length of travel of said slide along said slot means.

9. The door opening device of claim 1 further comprising an over-center spring for urging said first and second arms out of substantial parallel alignment with each other.

10. The door operating device of claim 1 wherein said start means includes an infrared transmitter and receiver.

11. A door operating device in accordance with claim 1 wherein one of said door open sensor means and said door closed sensor means comprises:

angle sensor means positioned around said one of said first and second axis for sensing the angle of said one of said first and second arms, and switch means responsive to said angle sensor means.

12. A door operating device in accordance with claim 1 wherein said second end of said first arm is slidable along said second end of said second arm.

13. A door operating device opening and closing a door in an opening in a wall, said device comprising in combination:

a first arm having a first and second end, said first end of said first arm pivotally attached to said wall for movement about a first axis, a second arm having a first and a second end, said first end of said second arm pivotally attached to said door for movement about a second axis, said second end of said first arm pivotally attached to said second end of said first arm, electric motor means for drivingly rotating one of said arms in a first direction about one of said first and said second axis, electrically operated clutch means for connecting and disconnecting said motor means from engagement with said one of said arms, start means, door open sensor means for detecting that said door is in an open condition, door closed sensor means for detecting that said door is in a closed condition, means for detecting an excessive current drawn by said motor, and control means connected to said motor means and said clutch means and responsive to said door open sensor means, said door closed sensor means, said means for detecting an excessive current and said start means, for directing electric power to said motor means and said clutch means upon actuation of said start means and for terminating electric power to said motor means and said clutch means and clutch mean upon receipt of a signal from one of said door open sensor means, said door closed sensor means, and said means for detecting an excessive current.

14. A door operating device in accordance with claim 13 and further comprising:

latch release means for selectively unlatching said door when the door is in a closed condition.

15. A door operating device in accordance with claim 13 and further comprising a latch means wherein said latch means is an electromagnet on one of said door and said wall and a magnetic plate on the other of said door and said wall.

16. A door operating device in accordance with claim 15 wherein said latch means is controlled by said start means.

17. A door operating device for opening and closing a door in an opening in a wall, said device comprising in combination:

a first arm having a first and a second end, said first end of said first arm pivotally attachable to said wall for movement about a first axis, a second arm having a first and a second end, said first end of said second arm pivotally attachable to said door for movement about a second axis, said second end of said first arm pivotally attached to said second end of said second arm, electric motor means for drivingly rotating one of said arms in a first direction about one of said first and said second axis, clutch means for connecting and disconnecting said motor means from engagement with said one of said arms, start means, door open sensor means for detecting when said door is opened, door closed sensor means for detecting when said door is closed, an over-center spring for urging said first and second arms out of substantial parallel alignment with each other, and control means connected to said motor means and responsive to said door open sensor means, said door closed sensor means and said start means, for directing electric power to said motor means upon actuation of said start means and for terminating electric power to said motor means upon receipt of a signal from one of said door open sensor means, and said door closed sensor means.

18. A door operating device opening and closing a door in an opening in a wall, said device comprising in combination:

a first arm having a first and a second end, said first end of said first arm pivotally attached to said wall for movement about a first axis.

a second arm having a first and a second end, said first end of said second arm pivotally attached to said door for movement about a second axis, said second end of said first arm pivotally attached to said second end of said first arm, electric motor means for drivingly rotating one of said arms in a first direction about one of said first and said second axis, electrically operated clutch means for connecting and disconnecting said motor means from engagement with said one of said arms, start means, door open sensor means for detecting that said door is in an open condition, door closed sensor means for detecting that said door is in a closed condition, means for interrupting electric power to said motor means and said clutch means in response to an excessive current drawn by said motor means, and control means connected to said motor means and said clutch means and responsive to said door open sensor means, said door closed sensor means, and said start means, for directing electric power to said motor means and said clutch means upon actuation of said start means and for terminating electric power to said motor means in said clutch means upon receipt of a signal from one of said door open sensor means, and said door closed sensor means.

19. A door operating device for opening and closing a door in an opening in a wall, said device comprising in combination:

a first arm having a first and a second end, said first end of said first arm pivotally attachable to said wall for movement about a first axis, a second arm having a first and a second end, said first end of said second arm pivotally attachable to said door for movement about a second axis, said second end of said first arm pivotally attached to said second end of said second arm, electric motor means for drivingly rotating one of said arms in a first direction about one of said first and said second axis, clutch means for connecting and disconnecting said motor means from engagement with said one of said arms, start means, angle sensor means positioned around said one of said first and second axis for sensing the angle of said one of said first and second arms, switch means responsive to said angle sensor means, and, control means connected to said motor means for selectively directing electric power to said motor means, said control means responsive to said start means and said switch means.

20. A door operating device in accordance with claim 19 wherein said control means is also responsive to said switch means for terminating power to said motor means.

* * * * *

UNITED STATES PATENT AND TRADEMARK OFFICE

CERTIFICATE OF CORRECTION

PATENT NO. : 5,634,296
DATED : June 3, 1997
INVENTOR(S) : Thomas J. Hebda

It is certified that error appears in the above-indentified patent and that said Letters Patent is hereby corrected as shown below:

In column 10, line 48, after "said" delete "first" and substitute -- second --.

In column 12, line 2, after "said" delete "first" and substitute -- second --.

Signed and Sealed this

Twenty-third Day of September, 1997

*Attest:*

*Attesting Officer*

BRUCE LEHMAN

*Commissioner of Patents and Trademarks*